US005197623A

United States Patent [19]

Wang

[11] Patent Number: 5,197,623

[45] Date of Patent: Mar. 30, 1993

[54] THERMAL SNACK JAR

[76] Inventor: Paul S. Wang, 13620 Benson Ave., Chino, Calif. 91710

[21] Appl. No.: 946,564

[22] Filed: Sep. 18, 1992

[51] Int. Cl.[5] ..... B65D 51/24; A47J 43/28

[52] U.S. Cl. ..... 220/212; 220/521; 220/735; 215/227; 215/228; 206/542; 206/546; 30/147; 30/150

[58] Field of Search ..... 220/212, 521, 735, DIG. 10; 215/227, 228, DIG. 5; 206/216, 223, 541, 542, 546; 30/142, 143, 147, 148, 149, 150

[56] References Cited

U.S. PATENT DOCUMENTS

| | | | |
|---|---|---|---|
| 51,957 | 1/1866 | Minor | 206/546 X |
| 1,452,337 | 4/1923 | Brecel | 30/147 X |
| 1,725,265 | 8/1929 | Glendinning | 206/546 |
| 2,371,505 | 3/1945 | Coffey | 220/735 X |
| 3,624,787 | 11/1971 | Newman | 220/212 |
| 3,679,093 | 7/1972 | Chang | 220/735 X |
| 3,722,779 | 3/1973 | Chang | 220/735 X |
| 3,874,554 | 4/1975 | Chang | 220/212 X |
| 4,216,875 | 8/1980 | Stanish | 220/212 |
| 4,539,749 | 9/1985 | Hyeong-Woon | 30/147 |
| 5,090,572 | 2/1992 | De Roseau | 206/542 |

*Primary Examiner*—Allan N. Shoap
*Assistant Examiner*—Vanessa Careito

[57] ABSTRACT

A thermal jar for carrying snacks, and which is provided with a removable receptacle for a spoon and fork and which is received in a channel in a top surface of the cover of the jar. The spoon and the fork are pivotally mounted to the underside to the top of the receptacle, and the top is hinged to the receptacle so that it may be opened to permit the spoon and fork to be turned to a position in which they protrudes through the ends of the receptacle, and the cover may then be closed down to a snap fit with the receptacle to hold the spoon and fork in place, and enable the receptacle to serve as a handle for the spoon and fork.

6 Claims, 2 Drawing Sheets

FIG. 4
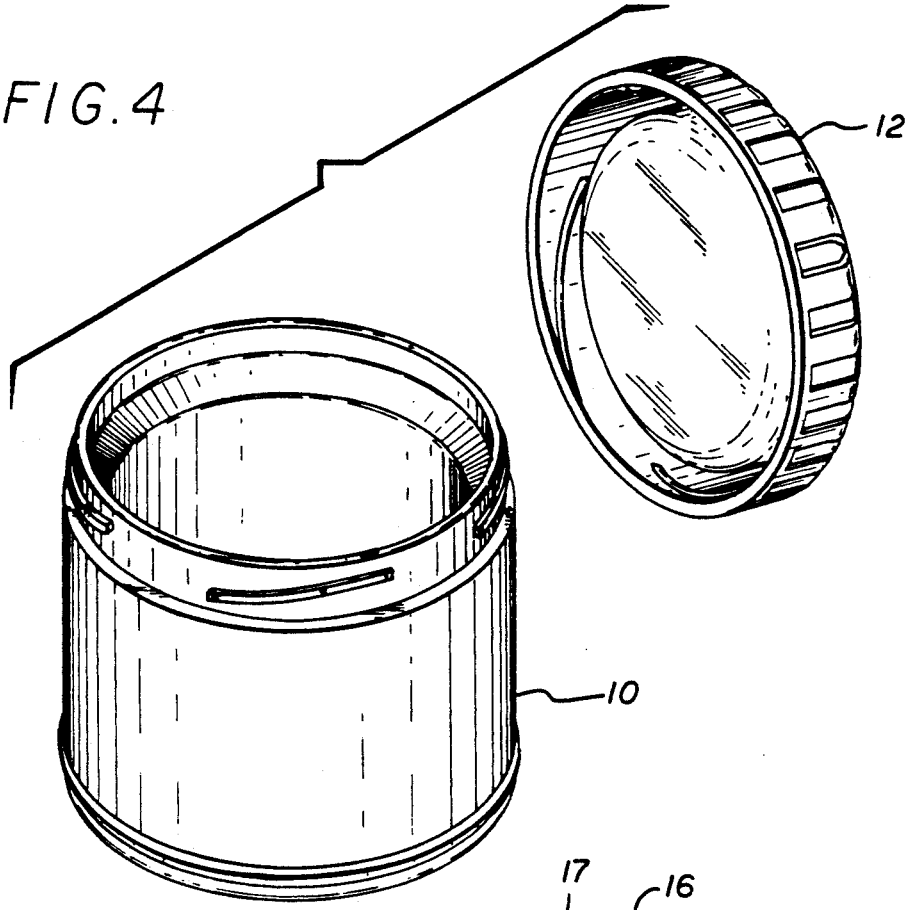
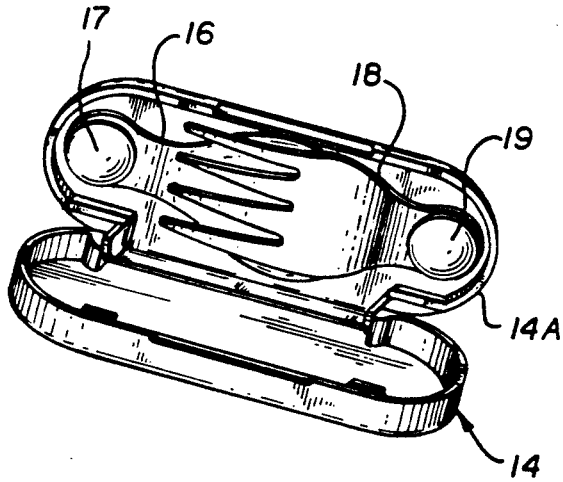
FIG. 5
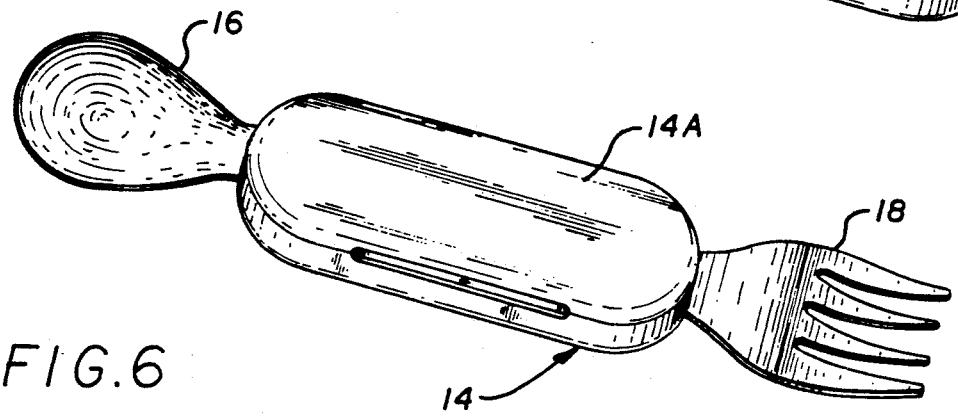
FIG. 6

THERMAL SNACK JAR

BACKGROUND OF THE INVENTION

A thermal jar is provided for carrying snacks, and the like, and which is provided with a removable receptacle for appropriate utensils, such as a spoon and fork the receptacle being received in a channel formed in a top surface of the cover of the jar in a snap fit relationship.

The jar of the invention is particularly useful for carrying snacks for children to school and on picnics.

The jar itself is preferably formed of a thermal insulating material, and its cover is also formed of a thermal insulating material and screwed to the open top of the jar.

The cover has a channel formed in its top surface for receiving the utensil receptacle in a snap-fit relationship. The end portions of appropriate utensils, such as a fork and spoon are pivotally mounted to the inner surface of the top of the receptacle, and they project through the ends of the receptacle when they are to be used. The fork and spoon may be turned to a position in which they overlap one another and are fully contained within the receptacle when not in use. Then, the receptacle top may be snapped to a closed position, and the receptacle itself may be snapped into the channel in the cover of the jar. A selected snack may be placed within the jar, and the cover of the jar with the receptacle in place may be screwed onto the open top of the jar.

To use the spoon and fork, the receptacle is removed from the channel in the cover, and its top is turned up to an open position. The spoon and fork are then turned until they protrude from each end of the receptacle. The receptacle top is then snapped down to its closed position to hold the spoon and fork in place. The spoon and fork may be used with the receptacle itself serving as a handle.

BRIEF DESCRIPTION OF THE DRAWINGS

FIG. 4 is a view of the assembly of FIG. 1 with the cover removed from the jar and showing the bottom surface of the cover;

FIG. 5 is a perspective of the utensil receptacle with its top turned to its opened position to reveal the utensils pivotally mounted to the inner surface of the top; and FIG. 6 is a perspective view of the receptacle showing the utensils turned to protrude through each end of the receptacle, so that the receptacle may serve as a handle for the utensils.

DETAILED DESCRIPTIONS OF THE ILLUSTRATED EMBODIMENT

The jar of the present invention is designated 10 in FIGS. 1–4, and it has a cover 12 screwed to its open top. The jar 10 and cover 12 are preferably formed of thermal insulating material, so that snacks, or other foods contained in the jar may be held in a cool or hot condition.

Figure 1:
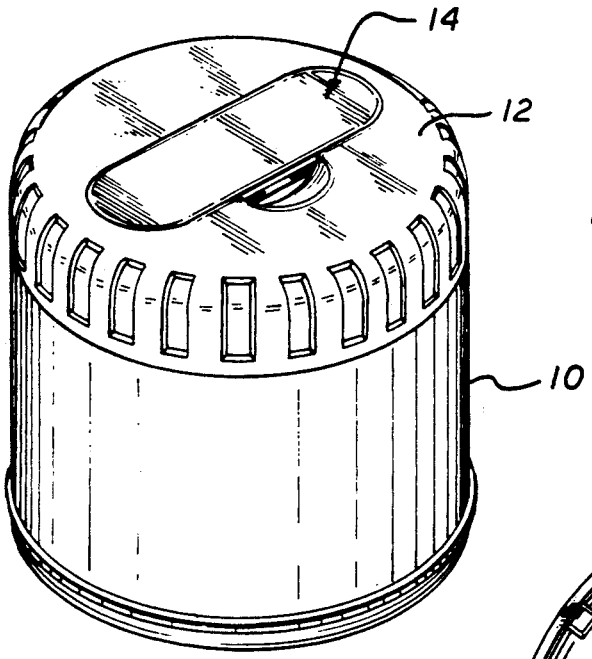
FIG. 1 is a side perspective view of the thermal jar of the present invention with the cover attached to the top of the jar, and with the utensil receptacle snapped into place in a channel in the cover.
Figure 2:
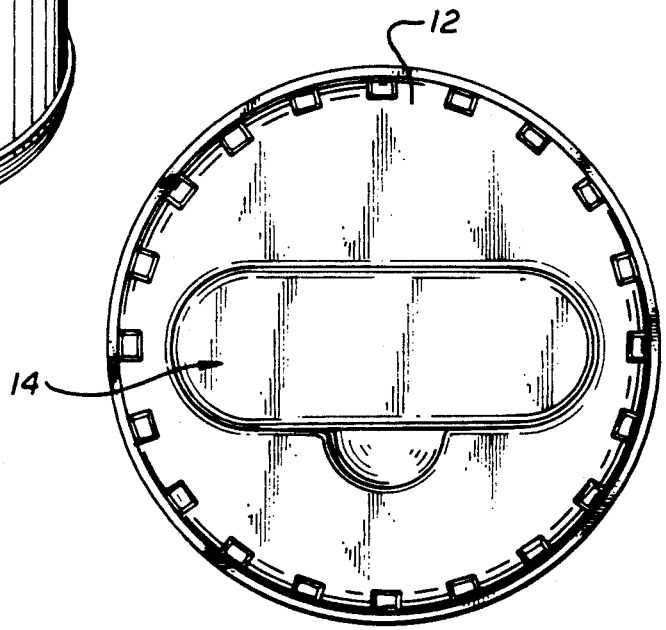
FIG. 2 is a top plan view of the assembly of FIG. 1.
Figure 3:
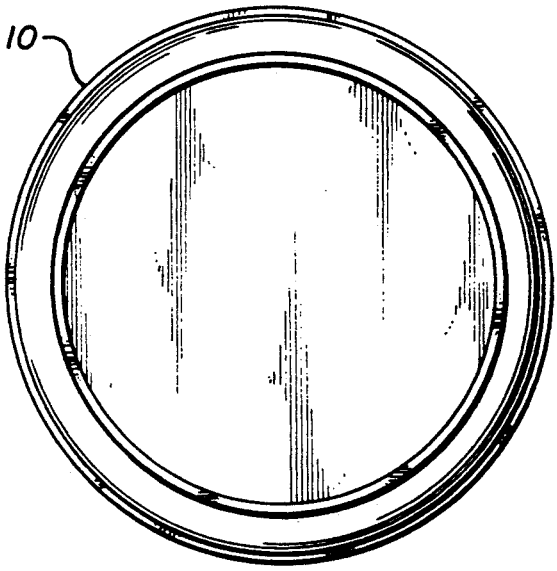
FIG. 3 is a bottom view of the assembly.

An elongated receptacle 14 is carried in an elongated channel formed on the outer surface of the cover 12, and it is snapped into a snap-fit relationship in the channel, as shown in FIGS. 1 and 2. The receptacle 14 has a top **14*a* as shown in FIGS. 5 and 6, which is hinged to the receptacle itself. Appropriate utensils, such as a spoon 16 and fork 18 are pivotally mounted to the underside of the top 14*a* by pivot pins and 19**.

The utensils themselves are actually the head portions of the spoon and fork. When the utensils are turned to the position shown in FIG. 5 in which they overlap one another, the top **14*a* of the receptacle 14 may be closed, and the receptacle may be placed in the channel in the cover 12 of the jar, as shown in FIG. 1**.

When the utensils are turned so that they protrude through the ends of the top **14*a*, as shown in FIG. 6, the top may be snapped closed and trap the utensils in the protruding position. Then, the utensils may be used with the receptacle 14** serving as a handle.

It will be appreciated that while a particular embodiment of the invention has been shown and described, modifications may be made. It is intended in the Claims to cover all modifications which come within the true spirit and scope of the invention.

I claim:

1. A container assembly including an open top jar and a cover removably attached to the jar, said cover having an upper surface and having a channel formed in said upper surface; a receptacle for at least one utensil removably received in said channel in a snap-fit relationship, said receptacle having a top hinged thereto, said top having an underside, at least one utensil pivotally mounted to said underside of said top and angularly moveably between a first position in which it extends inwardly along said underside of said top and a second position in which it protrudes beyond one end of said top to permit the top to be closed down on the receptacle to hold the utensil in place in its second position.

2. The assembly defined in claim 1 in which the top of said receptacle has a snap-fit relationship with the receptacle to hold the top in its closed position.

3. The assembly defined in claim 1 and which includes two utensils pivotally mounted on the underside of said top.

4. The assembly defined in claim 3 in which said utensils respectively comprise a spoon and a fork.

5. The assembly defined in claim 1 in which said jar and said cover are formed of thermal insulating material.

6. The assembly defined in claim 1 in which said cover is removably screwed to the top of said jar.

* * * * *